US012421736B2

(12) United States Patent
Hannig et al.

(10) Patent No.: US 12,421,736 B2
(45) Date of Patent: Sep. 23, 2025

(54) LEAK-PROOF AND UNBREAKABLE PANEL COMPRISING A LOCKING ELEMENT, AND METHOD FOR PRODUCING SUCH A PANEL

(71) Applicant: SURFACE TECHNOLOGIES GMBH & CO. KG, Baruth (DE)

(72) Inventors: Hans-Jürgen Hannig, Bergisch Gladbach (DE); Andreas Sieder, Ludwigsfelde (DE); Eberhard Herrmann, Wismar (DE); Carsten Buhlmann, Baruth (DE)

(73) Assignee: SURFACE TECHNOLOGIES GMBH & CO. KG, Baruth (DE)

( * ) Notice: Subject to any disclaimer, the term of this patent is extended or adjusted under 35 U.S.C. 154(b) by 122 days.

(21) Appl. No.: 18/036,116

(22) PCT Filed: Nov. 24, 2021

(86) PCT No.: PCT/EP2021/082854
§ 371 (c)(1),
(2) Date: May 9, 2023

(87) PCT Pub. No.: WO2022/156940
PCT Pub. Date: Jul. 28, 2022

(65) Prior Publication Data

US 2024/0018789 A1 Jan. 18, 2024

(30) Foreign Application Priority Data

Jan. 22, 2021 (EP) ..... 21153050

(51) Int. Cl.
*E04F 15/00* (2006.01)
*E04F 13/08* (2006.01)
*E04F 15/02* (2006.01)

(52) U.S. Cl.
CPC .... *E04F 15/02038* (2013.01); *E04F 13/0894* (2013.01); *E04F 2201/0146* (2013.01);
(Continued)

(58) Field of Classification Search
CPC ..... E04F 13/0894; E04F 13/0866; E04F 13/0871; E04F 15/02038; E04F 15/02033;
(Continued)

(56) References Cited

U.S. PATENT DOCUMENTS 7,131,473 B1 11/2006 Brewer
12,123,204 B2 * 10/2024 Fahle ..... E04F 13/0894
(Continued)

FOREIGN PATENT DOCUMENTS

EP 2236694 A1 10/2010
EP 2946047 B1 3/2019
(Continued)

OTHER PUBLICATIONS

First Office Action regarding Chinese Patent Application No. 202180072752.7, dated Jun. 17, 2024.
(Continued)

*Primary Examiner* — Chi Q Nguyen
(74) *Attorney, Agent, or Firm* — Harness, Dickey & Pierce, P.L.C.

(57) ABSTRACT

A panel comprises a panel body extending in a longitudinal direction and a transverse direction, a retaining groove extending in the transverse direction in an end short side of the panel body, and a locking element which is inserted in the retaining groove substantially immovably. For an extension $b_0$ of the retaining groove in the transverse direction relative to a nominal width B of the panel body between a first edge extending in the longitudinal direction and a second edge of the panel body extending in the longitudinal direction, the following applies: $0.50 \leq b_0/B \leq 0.97$. An
(Continued)

unbreakable and leak-proof panel having good and material-friendly locking is made possible by the retaining groove which extends over only a large portion of the short side and by the locking element immovably received in the retaining groove.

13 Claims, 2 Drawing Sheets

(52) U.S. Cl.
CPC ... *E04F 2201/023* (2013.01); *E04F 2201/043* (2013.01); *E04F 2201/0535* (2013.01); *E04F 2201/0552* (2013.01)

(58) Field of Classification Search
CPC ... E04F 15/107; E04F 13/14; E04F 2201/042; E04F 2201/0107; E04F 2201/023; E04F 15/08; E04F 2201/0115; E04F 2201/0153; E04F 2201/0552; E04F 2201/0535; E04F 2201/0146; E04F 2201/043; E04F 2201/0547; E04F 2201/0138; B32B 2471/00; B32B 3/06; B32B 7/12; B32B 19/04; B32B 2307/546; B32B 2419/04; B32B 2607/00
See application file for complete search history.

(56) References Cited

U.S. PATENT DOCUMENTS

| | | | | |
|---|---|---|---|---|
| 12,188,239 | B2 * | 1/2025 | Nilsson | E04F 15/02038 |
| 2013/0042562 | A1 * | 2/2013 | Pervan | E04F 13/0894 52/582.2 |
| 2013/0042563 | A1 * | 2/2013 | Pervan | E04F 15/02038 52/582.2 |
| 2013/0047536 | A1 * | 2/2013 | Pervan | E04F 15/105 52/309.1 |
| 2016/0177576 | A1 * | 6/2016 | Ramachandra | E04F 15/04 52/588.1 |
| 2021/0087831 | A1 * | 3/2021 | Nilsson | E04F 15/02033 |
| 2022/0025657 | A1 * | 1/2022 | Pervan | E04F 15/102 |
| 2024/0075730 | A1 * | 3/2024 | Larsson | B32B 38/0004 |
| 2024/0129452 | A1 * | 4/2024 | Zinkler | G06V 20/58 |
| 2024/0271429 | A1 * | 8/2024 | Meijer | E04F 13/0894 |

FOREIGN PATENT DOCUMENTS

| | | | |
|---|---|---|---|
| WO | 2006133690 | A1 | 12/2006 |
| WO | 2007079845 | A1 | 7/2007 |
| WO | 2010087752 | A1 | 8/2010 |

OTHER PUBLICATIONS

International Search Report (English and German) and Written Opinion of the ISA (German) issued in PCT/EP2021/082854, mailed Feb. 9, 2022; ISA/EP.

* cited by examiner

LEAK-PROOF AND UNBREAKABLE PANEL COMPRISING A LOCKING ELEMENT, AND METHOD FOR PRODUCING SUCH A PANEL

CROSS-REFERENCE TO RELATED APPLICATIONS

This application is a National Phase of International Application No. PCT/EP2021/082854, filed on Nov. 24, 2021, which claims the benefit of European Patent Application No. 21153050.6, filed on Jan. 22, 2021. The entire disclosure of the above European patent application is incorporated herein by reference.

FIELD

The disclosure relates to a panel having a high breaking strength and a high seep resistance against liquid reaching a lower surface of the panel, which can cover a surface of a room with the aid of panels interlocked with each other via an in particular fixed locking element, in particular to improve the visual appearance of the room and/or to cover the surface of the room with a material layer which is more suitable for the intended function, as well as a method by means of which such a panel can be manufactured.

BACKGROUND

This section provides background information related to the present disclosure which is not necessarily prior art.

From WO 2007/079845 A1 it is known to provide a retaining groove at a short side of a panel over the entire transverse extension of the panel, into which groove a locking element designed as a latching clip can be inserted immovably.

From WO 2010/087752 A1 it is known do saw a partially circular groove in a partial area at a short side of a panel, into which a projection of a locking element otherwise provided outside the groove can be displaced in the transverse direction, wherein the projection is able to slide along the rounded edges of the partially circular groove and thereby to press the locking element with a component of its movement in the longitudinal direction into an opposite groove of another panel.

There is a constant need to increase the breaking strength and the seep resistance of panels against penetration of liquid.

SUMMARY

This section provides a general summary of the disclosure, and is not a comprehensive disclosure of its full scope or all of its features.

It is the object of the disclosure to provide measures that enable a seep-resistant panel.

One embodiment of the disclosure relates to a panel for covering a surface of a room, comprising a panel element extending in a longitudinal direction and in a transverse direction for transferring use loads introduced at an upper surface of the panel element to a lower side of the panel element facing the surface of the room, wherein the upper side is spaced from the lower side in a thickness direction, and a retaining groove extending in an end face short side of the panel element in the transverse direction and a locking element inserted into the retaining groove, in particular substantially immovably, wherein, for an extension $b_0$ of the retaining groove in the transverse direction with respect to a nominal width B of the panel element between a first edge of the panel element extending in the longitudinal direction and a second edge of the panel element extending in the longitudinal direction, $0.50 \leq b_0/B \leq 0.97$, in particular $0.75 \leq B_0/B \leq 0.95$, preferably $0.85 \leq B_0/B \leq 0.93$, and particularly preferably $b_0/B = 0.90 \pm 0.02$.

The panel may comprise a panel element based on a cuboid as a basic shape, the longitudinal extension of which is generally significantly greater than its transverse extension, while the thickness of the panel element in the thickness direction is generally smaller than its transverse extension. At the one long side extending in the longitudinal direction, the panel element may comprise a bung projection extending in particular continuously in the longitudinal direction and projecting in the transverse direction, and at the other side may comprise a bung groove formed in the panel element in the transverse direction, so that essentially identically designed panels can be connected to one another abutting at the long sides by means of a tongue-and-groove connection configured in the form of a bung. In particular, a locking hook can protrude in the longitudinal direction from the transversely extending short side of the panel element, while a tongue body can protrude from the other short side of the panel element, which delimits a receiving groove, so that substantially identically configured panels can also be latched together at their short sides via a tongue-and-groove connection. In addition or alternatively to the tongue-and-groove connection formed with the aid of the locking hook and the receiving groove of the tongue body, the locking element can be inserted into the retaining groove provided at the short side of the one panel, in particular immovably, which can engage into a latching groove which is provided at a short side facing the locking element of another, in particular essentially identically designed panel. For this purpose, the locking element, which is designed in particular in the manner of a latching clip, may comprise a latching web with a latching lug that can be elastically pushed away when the panels are moved past during assembly, in order to snap elastically at least partially, in particular with the latching lug, into the latching groove in the designated end position of the panels to be interlocked, and thus to secure the interlocked panels against unintentional release. During assembly, the one panel can rest flat on a subsurface defining a plane of use, for example a floor, a side wall or a ceiling of a room. The other panel can optionally be slightly beveled, for example at an angle of about 30°, placed against an already mounted panel extending laterally next to the panel at the long side, and then be swiveled onto the subsurface, whereby the at least one interlocking of the panels facing each other at the short sides can be established. During interlocking, on the one hand the locking hook can be latched into the retaining groove of the further panel and on the other hand the locking element inserted into the retaining groove can be latched into the latching groove of the further panel substantially at the same time. The extension of the latching groove in the transverse direction corresponds in particular to the extension of the retaining groove in the transverse direction. In particular, an extension $c_0$ of the latching groove in the transverse direction with respect to the nominal width B of the panel element is $0.50 \leq c_0/B \leq 0.97$, in particular $0.75 \leq c_0/B \leq 0.95$, preferably $0.85 \leq c_0/B \leq 0.93$, and particularly preferably $c_0/B = 0.90 \pm 0.02$. Preferably the latching groove is configured identical to the retaining groove and/or produced by the same manufacturing process, which simplifies in particular the simultaneous and/or identical production of the retaining groove and the retaining groove. The retaining groove accommodating the preassembled locking element can be provided at the one short side of the panel, while the latching groove is provided at the other short side of the panel.

Since the retaining groove and/or the latching groove are not provided over the entire transverse extension of the panel element, but only in a partial area of the transverse extension, it is possible to avoid a weakening of the panel element in a transition area between the short side and the long side in the corners of the panel element. In this case, the knowledge was utilized that in the case of a retaining groove which is continuous in the transverse direction, both the retaining groove and a bung groove can terminate in a corner of the panel element, as a result of which a particularly large amount of material is missing in the transition region between the short side and the long side, and the strength of the panel could be impaired as a result. In addition outlet openings at the longitudinal edges of the panel, via which water could seep downwards, could be avoided. Instead, a bottom of the bung groove is also closed at the short side, providing an effective barrier against seeping water. However, since the retaining groove extending in the transverse direction at the short side is spaced apart from the bung groove extending in the longitudinal direction at the long side, sufficient material of the panel element remains between the retaining groove and the bung groove, so that a significant impairment of the strength of the panel element in the transition area between the short side and the long side compared to the strength of the remaining bung groove and/or the remaining retaining groove is avoided. The risk that in the case of heavy, in particular punctual, stress of the panel in the corners, for example when an office chair is driven over the corner or a table leg is supported at the corner, a damage occurs, is thus at least reduced. If the locking element is inserted into the retaining groove not movable but immovable, an air gap between the locking element and at least a part of the surfaces of the retaining groove facing the locking element can be minimized, in particular be eliminated by a press fit. A break-off of the material delimiting the retaining groove can thus be avoided. Instead, the locking element can fill a major portion of the volume of the retaining groove, in particular over 50%, preferably over 75%, further preferably over 85% and particularly preferably over 95%, whereby loads acting on the material of the panel element delimiting the retaining groove can be transferred via the locking element. The breaking strength of the panel, in particularly in the corner regions of the panel, is thus improved.

At the same time, a hydraulic communication between the retaining groove and the bung groove can be avoided or at least reduced. As a result, a greater collection volume at a T-joint of three panels, into which otherwise two bung grooves and one retaining groove would open, can be avoided compared to the flow cross section along the retaining groove in the transverse direction and/or along the bung groove in the longitudinal direction. A drop in capillary forces acting on penetrated liquids can be avoided, so that the penetrated liquid can also evaporate more easily at a T-joint at a later time and/or escape again from a joint between the panels. An accumulation of liquid in the collection volume, from which the liquid can reach the underside of the panel element, in particular due to a hydrostatic pressure increasing over time as a result of following liquid, remains there and thus promotes the formation of mold, is thus at least reduced or even avoided. The risk that liquid passes through joints between the panels to the underside of the panel is thus at least reduced, so that the seep resistance against liquid reaching the underside of the panel is improved.

The seep resistance of the panel can be measured by filling a liquid, in particular water, with a predefined specific volume into a vessel open at the bottom and top, so that a defined filling level results for the liquid in the vessel with a defined hydrostatic pressure resulting therefrom. The vessel filled with the liquid is placed centrally on a T-shaped joint intersection area formed between three interlocked panels on the upper sides of the three panels. The level of liquid remaining in the vessel after a predefined time is a measure of the seep resistance against penetration of liquid into the joint formed between the interlocked panels.

Since the retaining groove does not extend over the entire transverse extension of the panel element, the locking element can also have an extension in the transverse direction which is less than the entire transverse extension of the panel element. Here, the knowledge was utilized that the locking element in the design in the manner of a latching clip provides sufficiently good latching even with a smaller transverse extension due to the form-fit clip connection, so that it is not at all necessary to provide the latching over the entire transverse extension of the panel element. At the same time, the transverse extension of the latching element is still large enough so that the forces acting on the latching element during latching can be distributed over a larger area and the local mechanical loads on the latching element can be kept low. With the selected ratio of the extension $b_0$ of the retaining groove in the transverse direction with respect to the nominal width B of the panel element, an improved breaking strength and an improved seep resistance in the corner areas of the panel element is achieved, while at the same time a good latching with low component loads for the locking element is ensured. By means of the retaining groove, which extends only over a larger part of the short side, and the locking element accommodated in the retaining groove, a break-resistant and seep-resistant panel with good locking gentle on the material is enabled.

In particular, the locking element is inserted into the retaining groove in such a way that a movement of the locking element in the transverse direction is prevented in a frictional and/or form-fitting manner. In particular, it can be provided that the locking element hits on the corresponding end of the retaining groove and cannot be moved further. Preferably, a clearance fit is formed between the retaining groove and the locking element in the transverse direction. Particularly preferably, a press-fit is formed between the retaining groove and the locking element in the thickness direction, whereby a stiffening of the material of the panel element forming the retaining groove can be achieved. Suitable locking elements are described, for example, in WO 2007/079845 A1, the contents of which are hereby included by reference as a part of the disclosure.

In particular, a first reinforcing area having an extension $t_1$ in the transverse direction is formed between a first end of the retaining groove facing the first edge in the transverse direction, wherein a second reinforcing area with an extension $t_2$ in the transverse direction is formed between a second end of the retaining groove facing the second edge in the transverse direction, wherein for the first reinforcing region $0.005 \leq t_1/B \leq 0.090$, in particular $0.015 \leq t_1/B \leq 0.050$, preferably $0.020 \leq t_1/B \leq 0.030$ and particularly preferably $t_1/B = 0.025 \pm 0.002$ and/or for the second reinforcing region $0.005 \leq t_2/B \leq 0.090$, in particular $0.015 \leq t_2/B \leq 0.050$, preferably $0.020 \leq t_2/B \leq 0.030$ 20 and particularly preferably $t_2/B = 0.025 \pm 0.002$, with the proviso that $t_1 + b_0 + t_2 = B$ applies.

The respective reinforcing area adjoins the associated edge of the panel element and extends along the short side in the transverse direction to the associated end of the retaining groove. Thus, the reinforcing area is designed to be free of the retaining groove. Instead of the retaining groove, which would otherwise be provided in the reinforcing area, the volume of the otherwise present retaining groove is filled by the material of the panel element. This accumulation of material in the reinforcing area results in an increased stability and an increased breaking strength in the corner area of the panel element. At the same time, the respective reinforcing area is short enough so that a sufficiently large portion of the transverse extension of the short side remains for the retaining groove and the locking element inserted into the retaining groove.

Preferably, the panel element comprises at the first edge a bung groove extending into the panel element and at the second edge a bung projection projecting from the panel element, wherein $t_1<t_2$, in particular $0.75\leq t_1/t_2\leq 0.99$, preferably $0.80\leq t_1/t_2\leq 0.95$ and particularly preferably $0.85\leq t_1/t_2\leq 0.90$. Here it can be taken into account that due to the bung projection, the panel element is designed to be more stable and stronger at the second edge than at the first edge where the bung groove is provided. Thus, it can be allowed that the second reinforcing area is implemented in the transverse direction correspondingly shorter than the first reinforcing area. In the region of the joint between two panels abutting each other at the long sides and configured essentially identical, a joint reinforcing area $t_1+t_2$ is obtained at both long sides of the corresponding panel, wherein the first reinforcing area is provided by the one panel and the second reinforcing area is provided by the other panel. As a result, while achieving a good breakage safety in the area of the bung groove at the same time a good breakage safety at the joint of the bung formed at the long sides can be achieved. The bung groove is provided inside the panel element between the first edge and the second edge of the panel element. The bung projection projects from the rest of the panel element, with which the bung projection may be integrally formed, and is thereby arranged outside the nominal width B of the panel element measured from the first edge to the second edge, so that the extension of the bung projection does not contribute to the nominal width B of the panel element.

Particularly preferably, an extension $b_1$ of the locking element in the transverse direction with respect to the nominal width B of the panel element is $0.40\leq b_1/B\leq 0.95$, in particular $0.50\leq b_1/B\leq 0.90$, preferably $0.60\leq b_1/B\leq 0.80$ and particularly preferably $b_1/B=0.70\pm 0.05$. The extension of the locking element in the transverse direction of the panel element can in particular essentially correspond to the extension of the retaining groove in the transverse direction. However, it is also possible that the extension of the locking element in the transverse direction is selected to be slightly or significantly smaller than the extension of the retaining groove. For example, the extension of the locking element may be dimensioned substantially solely with respect to the latching functionality and the expected forces to withstand in this respect, whereby it is quite possible that the extension of the locking element can be selected to be smaller than the extension of the retaining groove. In this case, it is in principle also possible to adapt the extension of the retaining groove in the transverse direction to the required smaller extension of the locking element. However, if the extension of the retaining groove in the transverse direction is selected to be significantly larger than the extension of the locking element, alternative manufacturing options are available for the retaining groove. Instead of machining the retaining groove with a pin-shaped milling cutter advancing in the transverse direction, the diameter of which corresponds in particular to the extension of the retaining groove in the thickness direction, it is possible to produce the retaining groove by means of a circular saw or peripheral milling cutter cutting into the panel element, since a rounded feed-in area can be permitted at the ends of the retaining groove. The production of the retaining groove can thus be faster and less expensive.

In particular, a frictional fit of the locking element in the retaining groove is provided exclusively by clamping forces pointing in the thickness direction. The locking element can be clamped between an upper surface of the retaining groove in the thickness direction and a lower surface of the retaining groove. Preferably, hooks and/or mandrels projecting from the locking element are driven into the material of the locking element, which delimits the retaining groove, in a form-fitting manner. Clamping in the transverse direction is just not provided. Unnecessary shear forces acting on the locking element can thus be avoided. In addition, it is possible that the locking element can yield somewhat elastically in the transverse direction when inserted in the retaining groove, which facilitates pressing of the locking element into the retaining groove and/or driving of hooks and/or mandrels into the material of the retaining groove.

Preferably, the locking element comprises a latching web that can be elastically bent at least partially in the direction of the retaining groove. The locking element can thus be configured as a latching clip. If, when two panels are latched, one panel is moved past the other, in particular during a swiveling movement, the panel can bend the latching web elastically towards the retaining groove of the locking element and/or at least partially away into the retaining groove of the locking element, so that the panel can be moved past the locking element. In the intended end position, the locking element, in particular a latching lug of the latching web, can elastically snap into a latching groove of the panel moved past and bring about the latching connection. The latching web of the panel can engage at least partially in the latching groove of the other panel, thereby forming a tongue-and-groove connection.

Particularly preferably, the retaining groove comprises a receiving space adjoining one end face of the short side for receiving a part of the locking element, in particular for temporarily receiving an elastically bendable latching web of the locking element, and a fastening space adjoining the side of the receiving space facing away from the end face for fastening a fastening projection of the locking element in a frictional or form-fitting manner, wherein the extension of the fastening space in the thickness direction is smaller than the extension of the receiving space in the thickness direction. The fastening of the locking element in the retaining groove in particular in an immovable manner, can be achieved to a large extent or completely by means of the fastening projection of the locking element engaging into the fastening space. At the same time, the locking element can provide sufficient free space in the volume of the receiving space of the retaining groove into which the elastically flexible latching web of the locking element or another component bringing about a latching effect can engage when the panel to be latched is moved past. A relative movement of the panels provided for latching the two panels is not blocked by the locking element.

In particular, the locking element abuts at both surfaces of the receiving space facing in the thickness direction, in particular with a clamping force, wherein in particular the locking element comprises a receiving pocket extending into the receiving space for temporarily receiving an elastically flexible bonded latching web of the locking element. This enables to provide an immovable and/or, in particular, load-transferring fastening of the locking element in the retaining groove. It can even be permitted that the locking element can yield elastically in the direction of thickness within the volume of the receiving space. As a result, the locking element can be manufactured at lower cost. Since the locking element abuts the surfaces facing in the thickness direction, at least some frictional engagement is provided that can make it more difficult for the locking element to slip out of the retaining groove. Between the material areas of the locking element that abut the surfaces, a free volume for forming the receiving pocket can be provided. This allows a sufficient pivotability of the elastically bendable bonded latching web into the receiving pocket when a panel to be latched moves past and a good frictional engagement of the locking element within the retaining groove.

Preferably, at the short side forming the retaining groove, the panel element comprises a locking hook protruding from the short side of the panel element in the longitudinal direction for latching into a receiving groove of a further panel. This enables both latching of the one panel with another panel with the aid of the locking element engaging into a locking groove of the other panel and with the aid of the locking hook engaging into a retaining groove of the other panel. Suitable locking hooks and suitable tongue bodies comprising a retaining groove are described in WO 2006/133690 A1, the content of which is hereby included by reference as a part of the disclosure.

Particularly preferably, the retaining groove has a cross-sectional area in a cutting plane spanned by the longitudinal direction and the transverse direction, which can be produced by rotary machining and has rounded feed-out areas at the ends of the retaining groove facing in the transverse direction. Rotary machining is understood to mean a chip-removing production process with a rotating cutting movement on a workpiece that is fixed relative thereto with the aid of a rotating cutting tool with a geometrically defined cutting edge, for example circular sawing with a circular saw blade or milling with the aid of a peripheral milling cutter. In the case of rotary cutting, machining can take place with a circular cutting movement associated with the tool and any feed movement, wherein the axis of rotation of the cutting movement maintains its posture to the tool independently of the feed motion. The three-dimensional shape of the locking element can be adapted to the shape of the retaining groove, so that surfaces corresponding to one another can face one another and, in particular, can abut flat against one another. Preferably, the locking element is based essentially on a cuboidal basic shape, so that the locking element is inserted outside the rounded feed-out areas of the retaining groove into the retaining groove in particular in an immovable manner, whereby the production of the locking element can be more cost-effectively. Here, the knowledge is exploited that for providing the latching functionality of the locking element, also a smaller extension of the locking element in the transverse direction can be sufficient. The extension of the locking element can, for example, be substantially be dimensioned solely with respect to the latching functionality and the expected forces to withstand, whereby it is quite possible that the extension of the locking element can be selected to be smaller in comparison with the extension of the retaining groove. Instead of producing the retaining groove with a pin-shaped milling cutter advancing in the transverse direction, the diameter of which corresponds in particular to the extension of the retaining groove in the thickness direction, it is possible to produce the retaining groove by means of a circular saw or a peripheral milling cutter engaging into the panel element, since rounded feed-in areas at the ends of the retaining groove can be permitted. This allows the retaining groove to be produced more quickly and at lower cost.

In a further embodiment, the retaining groove comprises in a cross-sectional plane spanned by the longitudinal direction and the transverse direction, an in particular rectangular cross-sectional area which can be produced by milling. For example, in the case of very small panels in the transverse direction, thereby the entire extension of the retaining groove in the transverse direction can be used for receiving the locking element. Thus, rounded feed-in areas remaining free can be avoided.

A further embodiment of the disclosure relates to a method for producing a panel, which can be configured and further developed as described above, in which the retaining groove is formed by rotary machining by use of a cutting tool engaging at the short side of the panel element into the panel element and rotating around a rotary axis extending in the thickness direction, wherein the cutting tool engages into the panel element at a distance from the first edge and the second edge, is subsequently advanced linearly in the transverse direction relative to the panel element and subsequently the cutting tool exits from the panel element at a distance from the first edge and the second edge. The method can be configured and further developed in particular as explained above with reference to the panel. Due to the retaining groove, which extends only over a large part of the short side as a result of rotary machining, and the locking element accommodated in the retaining groove it possible to produce a break-proof panel with good latching gentle on the material.

In particular, the cutting tool comprises cutting teeth comprising a main cutting edge facing essentially in the radial direction with respect to the axis of rotation and two minor cutting edges facing essentially in opposite axial directions, wherein in addition to the main cutting edge, the two minor cutting edges engage the panel element in a chip-removing and/or smoothing manner in order to produce the retaining groove. The thickness of the cutting teeth in the thickness direction can be substantially wedge-shaped in the circumferential direction, so that the tooth flanks of the cutting teeth facing in the thickness direction can form clearance surfaces for a suitable wedge angle of the minor cutting edges. The minor cutting edges and the main cutting edge can share a common rake face. With the aid of the minor cutting edges the surfaces of the retaining groove produced by the main cutting edge and facing in the thickness direction can be finished in the same machining step, thus facilitating insertion of the locking element into the retaining groove. By smoothing the surfaces facing each other with the aid of the minor cutting edges, it is possible to reduce a scattering of surface roughness and coefficients of friction of the surfaces.

Preferably, the cutting tool comprises cutting teeth with radial extensions of different widths in the axial direction with respect to the axis of rotation, wherein in particular the cutting teeth have a radial profiling for simultaneous production of both a receiving space as well as a fastening space of the retaining groove. This enables that a part of the cutting tooth can engage less deeply into the material of the panel element, for example to create a part of the receiving space, while another part of the cutting tooth, offset in the axial direction, can engage deeper into the material of the panel element, for example to additionally create the fastening space.

DRAWINGS

The drawings described herein are for illustrative purposes only of selected embodiments and not all possible implementations, and are not intended to limit the scope of the present disclosure.

In the following, the disclosure will be explained by way of example with reference to the accompanying drawings based on preferred exemplary embodiments, wherein the features shown below may each individually or in any combination represent an aspect of the disclosure. In the figures.

Corresponding reference numerals indicate corresponding parts throughout the several views of the drawings.

DETAILED DESCRIPTION

Example embodiments will now be described more fully with reference to the accompanying drawings.

Figure 1:
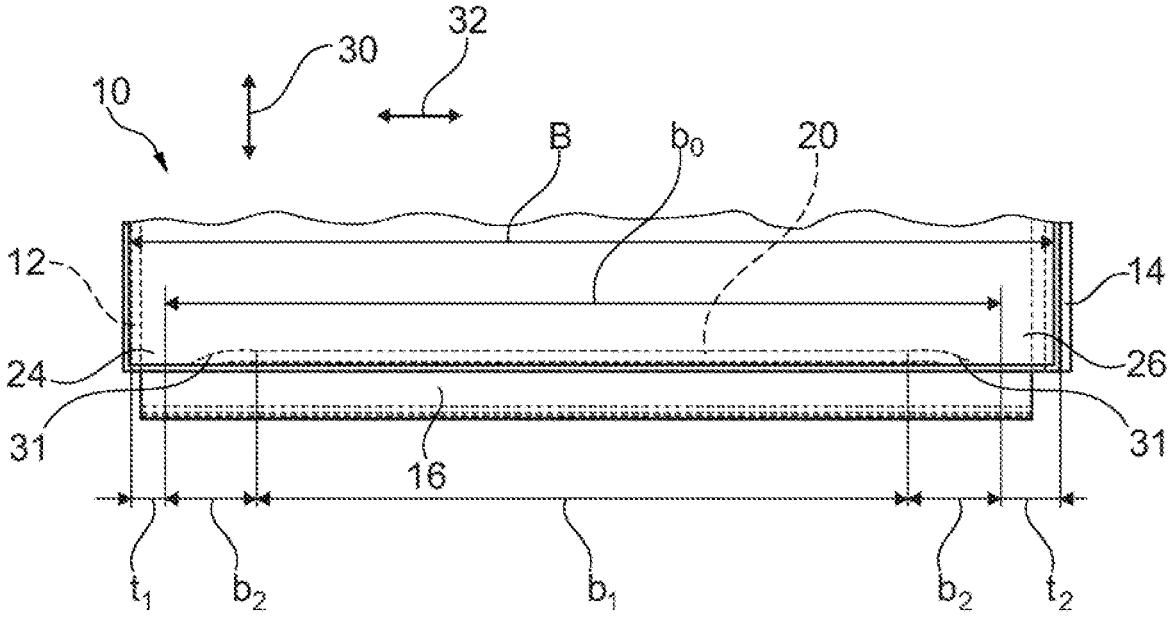
FIG. 1 is a schematic top view of an end portion of a panel.

Panel 10 shown in FIG. 1 can be used, for example as a floor laminate, for covering a surface of a room. The panel 10 can comprise at its respective long sides extending in the longitudinal direction 30 a bung groove 12 on the one hand and a bung projection 14 on the other hand. A nominal width B is provided between the long sides of the panel 10, wherein for the nominal width B between the edges of the panel 10 at the long sides the bung groove 12 and the bung projection 14 are disregarded and considered as non-existing. In particular, the panel 10 comprises at the short sides extending in the transverse direction 32, a locking hook 16 on the one hand, and a tongue body 18 which can cooperate with such a locking hook 16 on the other hand. For example, at the short side with the locking hook 16 a retaining groove 20 is formed, into which a locking element 22 can be inserted immovably. In this case, the retaining groove 20 does not extend over the entire nominal width B, but only over a partial section $b_0$, so that between the retaining groove 20 and the long side with the bung groove 12 a first reinforcing area 24 with an extension $t_1$ in the transverse direction 32 and between the retaining groove 20 and the long side with the bung projection 12 a second reinforcement area 26 with an extension $t_2$ in the transverse direction 32 remains. The retaining groove 20 may be produced by a groove cutter 40 engaging in the short side of a panel element 28 of the panel 10 and configured in the manner of a circular saw or circumferential cutter, so that rounded feed-out areas 31 with an extension $b_2$ in the transverse direction 32 are produced at the ends of the retaining groove 20. The extension $b_1$ of the retaining groove 20 remaining between the feed-out areas 31 can essentially correspond to the extension of the locking element 22 in the transverse direction 32.

Figure 2:
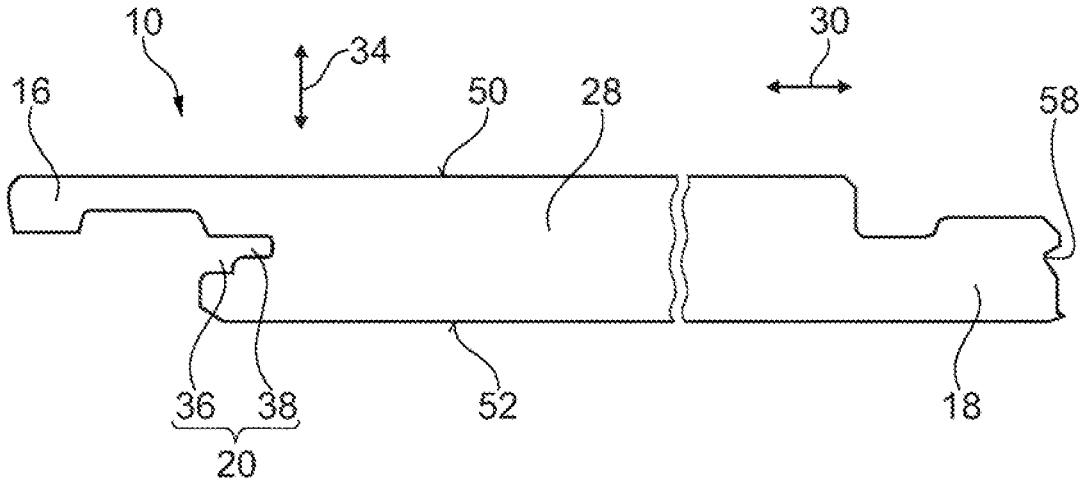
FIG. 2 is a schematic cutaway side view of the panel of FIG. 1.

As shown in FIG. 2, the retaining groove 20 may have different depths in the longitudinal direction 30 at different heights in a thickness direction 34 of the panel element 28. The retaining groove 20 thereby has a receiving space 36 adjoining the short side of the panel element 28 in the longitudinal direction 30 and a fastening space 38 projecting from the receiving space 36 in the longitudinal direction 30 into the interior of the panel element 28, which differ in their extension in the thickness direction 34. The extension of the receiving space the thickness direction 34 is greater than the extension of the fastening space 38 in thickness direction 34.

Figure 3:
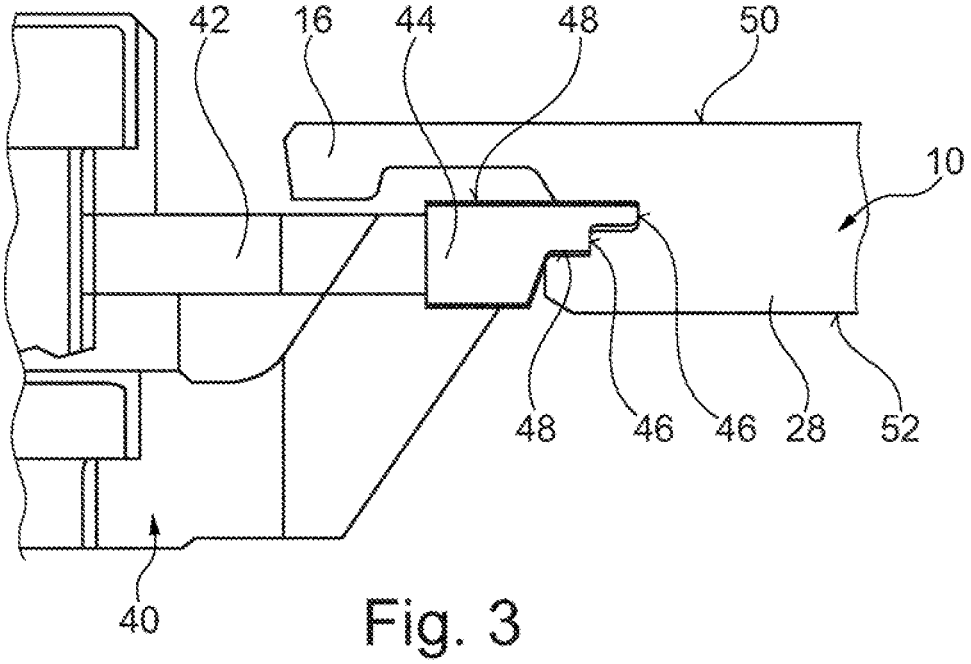
FIG. 3 is a schematic cutaway side view of the panel of FIG. 2 during production.

As shown in FIG. 3, the stepped retaining groove 20 can be formed by use of a groove miller formed in the type of a circular saw or a circumferential cutter 40. The groove cutter 40 comprises for this purpose a cutting tool 42, on the radially outer side of which cutting teeth 44 are provided. The cutting teeth 44 are profiled radially outwardly in a stepped manner so that main cutting edges 46 offset in the radial direction are obtained. The receiving space 36 with the shorter extension in the longitudinal direction 30 and the fastening space 38 with the greater extension in the longitudinal direction 30 can thus be produced in a common manufacturing step. In addition, the cutting teeth 44 have minor cutting edges 48 facing in the thickness direction 34, so that the entire retaining groove 20 with a defined surface can be produced. The retaining groove 20 can be spaced apart from an upper side 52 of the panel element 28 to such an extent in the thickness direction 34 that the cutting tool 42 of the groove cutter 40 can be guided past the locking hook 16. At the same time, the retaining groove 20 is spaced far enough from a lower side 50 of the panel element 28 in the thickness direction 34, so that a sufficient strength of the panel element 28 is also provided in the region of the retaining groove 20. Preferably, the retaining groove 20 is produced by use of the groove cutter 40 while the upper side 52 of the panel 10 faces downward and the lower side 50 of the panel 10 faces upward so that the locking hook 16 overlapping the cutting teeth 44 above can discharge separated chips downward.

Figure 4:
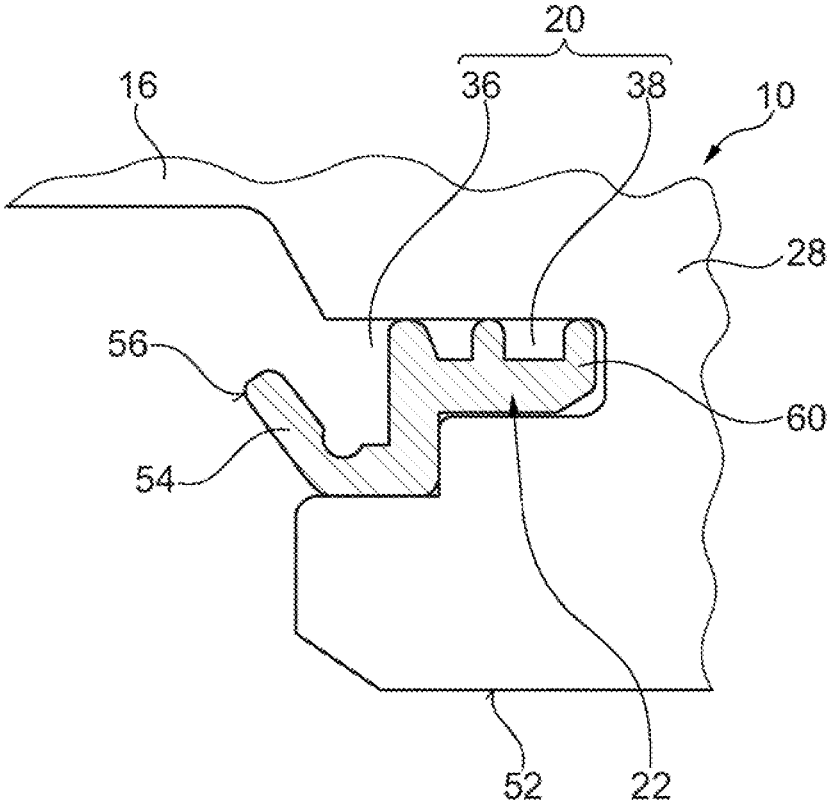
FIG. 4 is a schematic cutaway side view of a detail of the panel of FIG. 1 with an inserted locking element.

As shown in FIG. 4, the locking element 22 may include a fastening projection 60 pressed into the fastening space 38 of the retaining groove 20. If necessary, the locking element 22 may also be pressed into a portion of the receiving space 38 of the retaining groove 20 facing the fastening space 38. The locking element 22 comprises a latching web having a latching lug 56, which can slide on the outside of the other panel during locking with another panel and thus can be swiveled elastically in the direction of the receiving space 36 of the retaining groove 20 and optionally can be swiveled wholly or partially into a receiving pocket kept free by the locking element 22. When the designated relative posture of the panel 10 to the other panel is assumed, the latching web 54 can elastically snap out of the receiving space 36 so that the latching lug 56 can engage in a corresponding latching groove 58 and result in latching.

The foregoing description of the embodiments has been provided for purposes of illustration and description. It is not intended to be exhaustive or to limit the disclosure. Individual elements or features of a particular embodiment are generally not limited to that particular embodiment, but, where applicable, are inter-changeable and can be used in a selected embodiment, even if not specifically shown or described. The same may also be varied in many ways. Such variations are to be regarded as a departure from the disclosure, and all such modifications are intended to be included within the scope of the disclosure.

The invention claimed is:

1. A panel for covering a surface of a room, comprising a panel element extending in a longitudinal direction and in a transverse direction for transferring use loads introduced at an upper side of the panel element to a lower side of the panel element facing the surface of the room, wherein the upper surface is spaced apart from the lower side in a thickness direction;

a retaining groove extending in an end face short side of the panel element in the transverse direction; and a locking element inserted into the retaining groove, in particular immovably, wherein, for an extension $b_0$ of the retaining groove in the transverse direction with respect to a nominal width B of the panel element between a first edge of the panel element extending in the longitudinal direction and a second edge of the panel element extending in the longitudinal direction $0.50 \leq b_0/B \leq 0.97$, wherein a first reinforcing area with an extension $t_1$ in the transverse direction is formed between a first end of the retaining groove facing the first edge in the transverse direction, wherein a second reinforcing area with an extension $t_2$ in the transverse direction is formed in the transverse direction between a second end of the retaining groove facing the second edge in the transverse direction, wherein for the first reinforcing area $0.005 \leq t_1/B \leq 0.090$ and/or for the second reinforcing region $0.005 \leq t_2/B \leq 0.090$.

2. The panel according to claim 1, wherein the panel element comprises at the first edge a bung groove extending into the panel element and at the second edge a bung projection projecting from the panel element, wherein $t_1 < t_2$.

3. The panel according to claim 1, wherein for an extension $b_1$ of the locking element in the transverse direction with respect to the nominal width B of the panel element $0.40 \leq b_1/B \leq 0.95$.

4. The panel according to claim 1, wherein a frictional engagement of the locking element in the retaining groove is achieved exclusively by means of clamping forces point in the thickness direction.

5. The panel according to claim 1, wherein the locking element comprises a latching web elastically bent at least partially in the direction into the retaining groove.

6. The panel according to claim 1, wherein the retaining groove comprises a receiving space adjoining an end face of the short side for receiving a part of the locking element for temporarily receiving an elastically flexible latching web of the locking element, and a fastening space adjoining the side of the receiving space facing away from the end face for fastening a fastening projection of the locking element in a frictional and/or form-fitting manner, wherein the extension of the fastening space in the thickness direction is smaller than the extension of the receiving space in the thickness direction.

7. The panel according to claim 6, wherein the locking element abuts at both surfaces of the receiving space facing in the thickness direction with a clamping force, wherein the locking element comprises a receiving pocket extending into the receiving space for temporarily receiving an elastically bendable latching web of the locking element.

8. The panel according to claim 1, wherein the panel element comprises at the short side forming the retaining groove a locking hook projecting in the longitudinal direction from the short side of the panel element for latching into a retaining groove of a further panel.

9. The panel according to claim 1, wherein the retaining groove comprises in a cross-sectional plane spanned by the longitudinal direction and the transverse direction at the ends of the retaining groove facing in the transverse direction a rounded feed-out area produced by rotary machining.

10. The panel according to claim 1, wherein the retaining groove comprises in a cross-sectional plane spanned by the longitudinal direction and the transverse direction a cross-sectional area produced by milling.

11. A method of producing a panel according to claim 1, comprising forming the retaining groove by rotary machining by use of a chip-removing tool engaging into the panel element at the short side of the panel element and rotating about an axis of rotation extending in the thickness direction, wherein the cutting tool engages into the panel element at a distance from the first edge and the second edge, subsequently is linearly moved in the transverse direction relative to the panel element, and subsequently the cutting tool exits from the panel element spaced from the first edge and the second edge.

12. The method according to claim 11, wherein the cutting tool comprises cutting teeth comprising, with respect to the axis of rotation, a major cutting edge facing in a substantially radial direction and two minor cutting edges facing in substantially opposite axial directions, wherein, in addition to the major cutting edge, the two minor cutting edges engage in the panel element in a chip-removing and/or smoothing manner in order to produce the retaining groove.

13. The method according to claim 11, wherein the cutting tool comprises cutting teeth having radial extensions of different widths in the axial direction with respect to the axis of rotation, wherein the cutting teeth have a radial profiling for simultaneously producing both a receiving space and a fastening space of the retaining groove.

* * * * *